US007281879B2

(12) United States Patent
Cho et al.

(10) Patent No.: US 7,281,879 B2
(45) Date of Patent: Oct. 16, 2007

(54) PORTABLE FLOOD-BARRIERS SYSTEM

(75) Inventors: Yong Min Cho, Silver Spring, MD (US); Philip Yong Kim, Adelphi, MD (US)

(73) Assignee: Mentor Technologies, Inc., College Park, MD (US)

( * ) Notice: Subject to any disclaimer, the term of this patent is extended or adjusted under 35 U.S.C. 154(b) by 0 days.

(21) Appl. No.: 11/273,250

(22) Filed: Nov. 15, 2005

(65) Prior Publication Data

US 2006/0147271 A1 Jul. 6, 2006

Related U.S. Application Data

(63) Continuation of application No. 10/441,210, filed on May 20, 2003, now abandoned.

(51) Int. Cl.
*E02B 3/10* (2006.01)

(52) U.S. Cl. ..... 405/91; 405/107; 405/90; 405/115

(58) Field of Classification Search ..... 405/107, 405/114, 115, 91, 90, 87
See application file for complete search history.

(56) References Cited

U.S. PATENT DOCUMENTS

| | | | | |
|---|---|---|---|---|
| 4,279,540 A * | 7/1981 | Suga et al. | ..... | 405/115 |
| 5,735,636 A * | 4/1998 | Szita et al. | ..... | 405/116 |
| 6,102,620 A * | 8/2000 | Muramatsu | ..... | 405/115 |
| 6,354,762 B1 * | 3/2002 | Muramatsu | ..... | 405/115 |

* cited by examiner

*Primary Examiner*—Frederick L. Lagman
(74) *Attorney, Agent, or Firm*—Harness, Dickey & Pierce, P.L.C.

(57) ABSTRACT

A portable flood-barrier-system can include a portable block of substantial mass; and a deflatable bladder, a first portion of which is disposed on a substrate; the block being disposed at least partly on the first portion of the bladder so as to releasably compress the first portion between the block and the substrate and so releasably hold the first portion therebetween due to friction.

12 Claims, 3 Drawing Sheets

PORTABLE FLOOD-BARRIERS SYSTEM

CROSS-REFERENCE TO RELATED APPLICATIONS

This application is a continuation of U.S. patent application Ser. No. 10/441,210 filed on May 20, 2003 and now abandoned, the entirety of which hereby is incorporated herein by reference.

BACKGROUND

Every year, during the summer and fall seasons, we experience heavy rainfalls and flooding. Whenever there is heavy rainfall, the problems of flooding streets and the safety of levees arise. The flooding of streets and cities results in the loss of human life and millions of dollars worth of property damage.

SUMMARY

An embodiment of the present invention provides a portable or mobile flood-barriers system, e.g., which will be able to protect property from floods, flooding—rising water levels, etc., and so can function similarly to a levee or floodwall or can function to supplement a levee or floodwall, on a permanent or temporary basis. The system can include: a portable block of substantial mass, e.g., a New Jersey concrete safety shape barrier (also known as a New Jersey wall or Jersey wall); and a deflatable bladder, e.g., a long rubber-lining airbed. The New Jersey wall can serve as a first or main flood-barrier to flooding. Air will be pumped into the airbed and this serves as a second or secondary flood-barrier. The airbed can reduce if not seal the gaps between concrete wall bottoms and the ground and in between the wall sections (where arranged end-to-end) so as to reduce if not prevent the passage of flood water.

A portable flood-barriers system according to an embodiment of the present invention can protect streets, properties, cities, etc. from floods and flooding. It may also be used to provide levees with extra height in place of limited height sand bags or other temporary and limited height barriers. It is easy and quick to install, more secure than sand bags, and it gives protection from floods in terms of property and/or human lives.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

Figure 1:
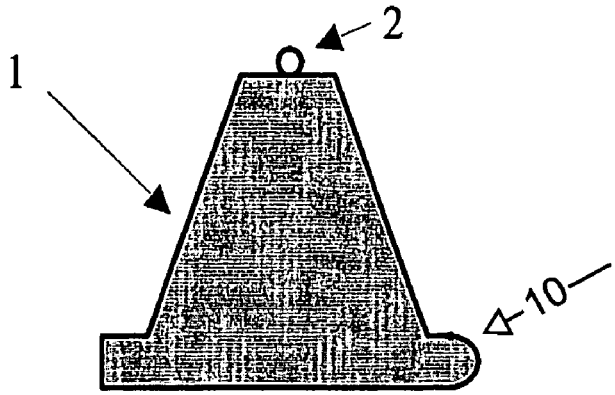
FIG. 1 is a conceptual side view of a portable block of substantial mass, e.g., a New Jersey concrete safety shape barrier, according to an embodiment of the present invention.
Figure 5:
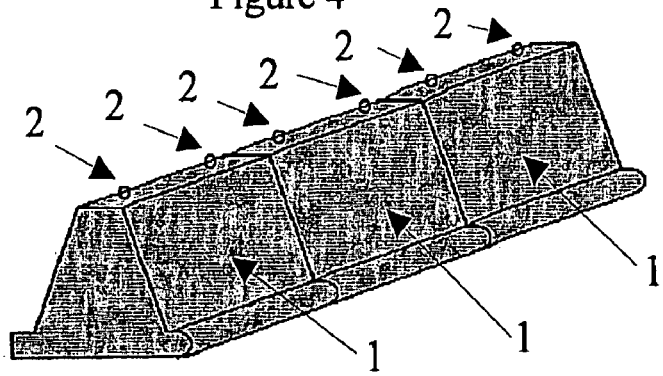
FIG. 5 is conceptual three-quarter perspective view of multiple portable blocks of substantial mass, e.g., New Jersey concrete safety shape barriers, connected together end-to-end, according to an embodiment of the present invention.

In FIGS. 1 and 5, a portable block of substantial mass 1, e.g., a concrete safety shape barrier (such as the New Jersey type, the F-shape type, the Ontario tall wall type, the constant-slope type, the GM type, etc.), has attachment rings 2. Alternatively, block 1 can be described as a massive yet portable block. The attachment rings 2 can be used to help transport and/or position the block 1, e.g., a New Jersey type concrete wall. The rings 2 can also be used for securing, e.g., tethering, an otherwise free (or tetherable) portion 12 of a deflatable bladder 3 (not shown in FIG. 1 but see FIG. 2) to the block 1. The bladder 3 can be, e.g., a long cylindrical rubber-lining (or some other substantially gas-impermeable construction) flat airbed.

The block 1, in cross-section, can be substantially trapezoidal. The block 1 can include a bull-nose flange 10 extending from a base portion of the block 1. A to-be-pinched portion 14 of the bladder 3 extends generally horizontally underneath the block 1. The tetherable portion 12 of the bladder, when inflated with a gas (such as air) or a liquid, extends generally vertically such that the bladder 4 wraps partially around the bull-nose flange 10.

Figure 2:
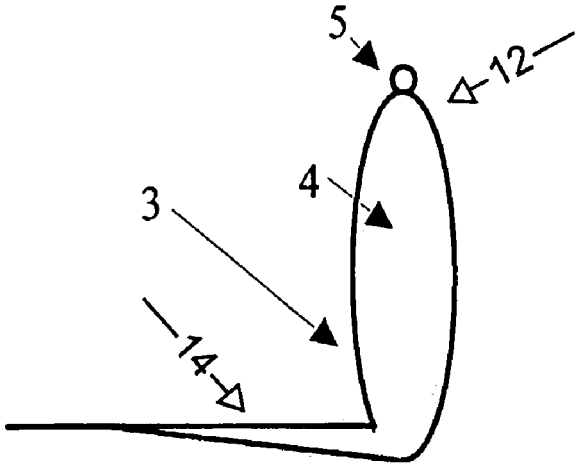
FIG. 2 is a conceptual side view of a deflatable bladder in an inflated state, e.g., an inflated long rubber-lining flat airbed, according to an embodiment of the present invention.
Figure 4:
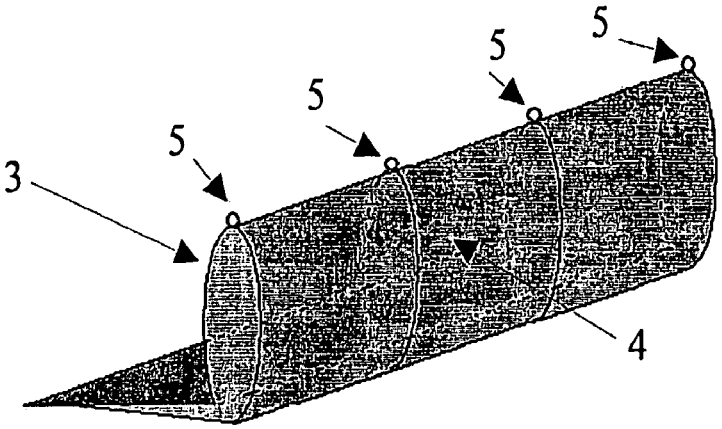
FIG. 4 is a conceptual three-quarter perspective view of a deflatable bladder in an inflated state, e.g., an inflated long rubber-lining flat airbed, according to an embodiment of the present invention.
Figure 6:
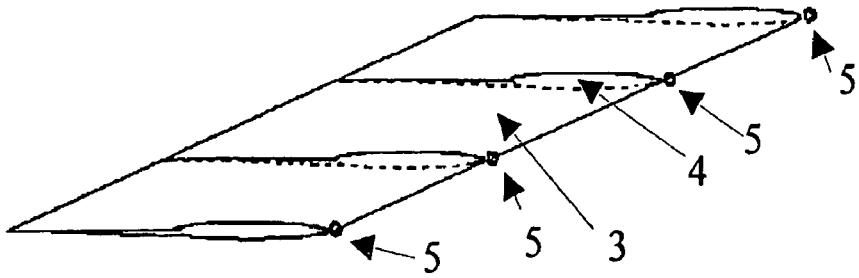
FIG. 6 is a conceptual three-quarter perspective view of a deflatable bladder, e.g., a long rubber-lining flat airbed, in a substantially deflated state, according to an embodiment of the present invention.

In FIGS. 2, 4, and 6, the long rubber-lining flat airbed 3 is at least partially inflated with a gas or liquid 4 (e.g., air) has attachment rings 5, which can be used to tether the airbag 3 to the New Jersey type concrete wall 1.

Figure 3:
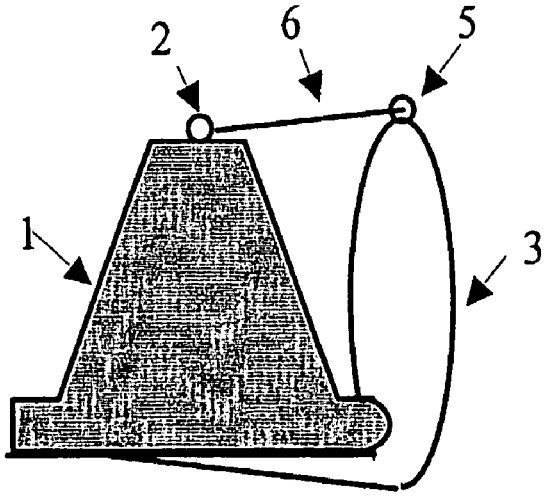
FIG. 3 is a conceptual side view of the New Jersey type concrete wall sitting on an inflated long rubber-lining flat airbed, according to an embodiment of the present invention.

In FIG. 3, a New Jersey type concrete wall 1 sitting on the long rubber-lining flat airbed 3 is secured by a string 6 (e.g., a rope, claim, cable, etc.) connected between the rings 2 on the wall and the rings 5 on the airbed. In other words, the to-be-pinched portion 14 of the bladder 3 is disposed on a substrate. The block 1 is disposed at least partly on the to-be-pinched portion 14 of the bladder 1 so as to releasably compress the to-be-pinched portion 14 between the block 1 and the substrate. As such, the block 1 can releasably hold the portion 14 of the bladder 14 between itself and the substrate due to friction induced by gravitation force up block 1.

Figure 7:
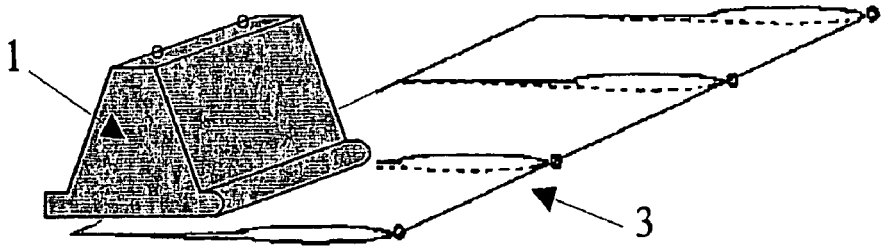
FIG. 7 is a conceptual three-quarter perspective view of a portable and substantially massive block sitting on a deflatable bladder in a deflated state, according to an embodiment of the present invention.

In FIG. 7, a New Jersey type concrete wall 1 sits partially on the long rubber-lining flat airbed 3.

Figure 8:
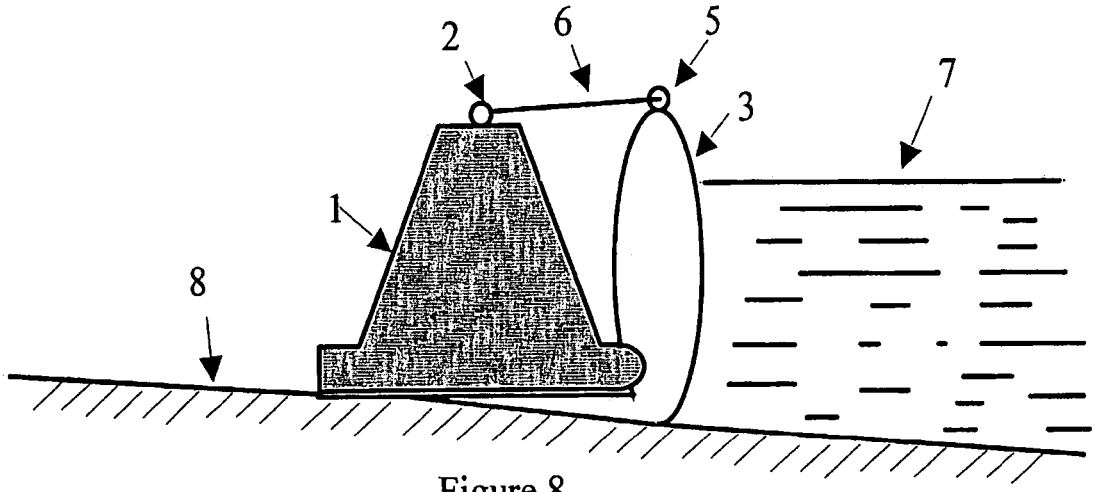
FIG. 8 is a conceptual side view of a portable & substantially massive block sitting on a deflatable bladder in an inflated state, together serving as a portable or mobile flood-barrier, according to an embodiment of the present invention.

In FIG. 8, a New Jersey type concrete wall 1 sitting on the long rubber-lining flat airbed 3 is secured by string 6 connected between rings 2 on the wall and rings 5 on the airbed. The to-be-pinched portion 14 of the long rubber-lining flat airbed 3 lies on a riverbed (or seabed, lakebed, etc.) 8 and remaining portions (especially when inflated) in combination with the wall 1 serve as a flood-barrier, blocking the water 7.

With some embodiments of the present invention having thus been described, it will be obvious that the same may be varied in many ways. Such variations are not to be regarded as a departure from the spirit and scope of the present invention, and all such modifications are intended to be included within the scope of the present invention.

What is claimed is:

1. A portable flood-barrier system comprising:

a massive yet portable block; and a deflatable bladder, a first portion of which is disposed on a substrate;

the block being disposed at least partly on the first portion of the bladder so as to releasably compress the first portion between the block and the substrate and so releasably hold the first portion therebetween due to friction.

2. The system of claim 1, further comprising:

a plurality of tethers to connect a second portion of the bladder to a top surface of the block;

wherein a bottom surface of the block presses against the first portion;

wherein the second portion is located generally opposite to the first portion; and wherein the top surface of the block is located generally opposite to the bottom surface.

3. The system of claim 1, wherein the block, in cross-section, is substantially trapezoidal.

4. The system of claim 1, wherein the substrate is a surface over which flood-liquid would flow if the portable flood-barrier system was not present.

5. The system of claim 1, wherein a longitudinal axis of the block is substantially perpendicular to a primary direction which the portable flood-barrier system is intended as a barrier to a flow of flood-liquid.

6. The system of claim 5, wherein a longitudinal axis of the flood-barrier system is substantially perpendicular to the primary direction which the portable flood-barrier system is intended as a barrier to a flow of flood-liquid.

7. A portable flood-barrier system comprising:

a block; and a deflatable bladder, a first portion of which is disposed on a substrate;

the block being disposed at least partly on the first portion of the bladder so as to releasably compress the first portion between the block and the substrate and so releasably hold the first portion therebetween due to friction;

wherein the block is a concrete barrier.

8. The system of claim 7, wherein the concrete barrier is a safety shape barrier.

9. The system of claim 8, wherein the massive yet portable block is one of a New Jersey concrete safety shape barrier, an F-shape barrier, an Ontario tall-wall barrier, a constant-slope barrier and a GM barrier.

10. A portable flood-barrier system comprising:

a block; and a deflatable bladder, a first portion of which is disposed on a substrate;

the block being disposed at least partly on the first portion of the bladder so as to releasably compress the first portion between the block and the substrate and so releasably hold the first portion therebetween due to friction;

wherein the block includes a bull-nose flange extending from a base portion of the block;

wherein the first portion, extends generally horizontally underneath the block; and wherein other portions of the bladder, when inflated, extend generally vertically such that the bladder wraps partially around the bull-nose flange.

11. A portable flood-barrier system comprising:

a massive yet portable block; and a deflatable bladder, a first portion of which is disposed on a substrate;

the block being disposed at least partly on the first portion of the bladder so as to releasably compress, via at least a gravitational force induced upon the block, the first portion between the block and the substrate and so releasably hold the first portion therebetween due to friction.

12. A portable flood-barrier system comprising:

a block; and a deflatable bladder, a first portion of which is disposed on a substrate;

the block being disposed at least partly on the first portion of the bladder so as to releasably compress, via at least a gravitational force induced upon the block, the first portion between the block and the substrate and so releasably hold the first portion therebetween due to friction;

wherein the block is disposed to releasably compress the first portion of the bladder due primarily to the gravitational force.

* * * * *